US011286544B2

(12) United States Patent
Jiang et al.

(10) Patent No.: US 11,286,544 B2
(45) Date of Patent: Mar. 29, 2022

(54) CALCIUM-BEARING MAGNESIUM AND RARE EARTH ELEMENT ALLOY AND METHOD FOR MANUFACTURING THE SAME

(71) Applicant: The Boeing Company, Chicago, IL (US)

(72) Inventors: Haitao Jiang, Beijing (CN); Qiang Kang, Beijing (CN); Yun Zhang, Beijing (CN); Peng Liu, Beijing (CN); Peng Dong, Beijing (CN); Zhe Xu, Beijing (CN); Chaomin Liu, Beijing (CN)

(73) Assignee: The Boeing Company, Chicago, IL (US)

( * ) Notice: Subject to any disclaimer, the term of this patent is extended or adjusted under 35 U.S.C. 154(b) by 121 days.

(21) Appl. No.: 16/471,168

(22) PCT Filed: Sep. 11, 2017

(86) PCT No.: PCT/US2017/050913
§ 371 (c)(1),
(2) Date: Jun. 19, 2019

(87) PCT Pub. No.: WO2018/132134
PCT Pub. Date: Jul. 19, 2018

(65) Prior Publication Data

US 2020/0017939 A1 Jan. 16, 2020

(30) Foreign Application Priority Data

Jan. 11, 2017 (CN) ..... 201710020396.X

(51) Int. Cl.
*C22C 23/02* (2006.01)
*B21B 1/02* (2006.01)
(Continued)

(52) U.S. Cl.
CPC ..... *C22C 23/02* (2013.01); *B21B 1/026* (2013.01); *B21B 27/024* (2013.01); *B21J 1/02* (2013.01);
(Continued)

(58) Field of Classification Search
CPC ..... C22C 23/02; C22C 1/03; C22C 23/04; B21B 1/026; B21B 27/024;
(Continued)

(56) References Cited

U.S. PATENT DOCUMENTS 6,139,651 A 10/2000 Bronfin et al.
2003/0183306 A1* 10/2003 Hehmann ..... C23C 14/22 148/404
(Continued)

FOREIGN PATENT DOCUMENTS

CN 101078080 A * 11/2007 ..... C22F 1/06
CN 103643096 A * 3/2014
(Continued)

OTHER PUBLICATIONS

Avedesian et al., ASM Handbook: Properties and Selection: Nonferrous Alloys and Special-Purpose Materials ASM Specialty Handbook—Magnesium and Magnesium Alloys: Bulk working, 1999, ASM, vol. 2, p. 85-89 (Year: 1999).*
(Continued)

*Primary Examiner* — Christopher S Kessler
*Assistant Examiner* — Andrew M Cheung
(74) *Attorney, Agent, or Firm* — Walters & Wasylyna LLC

(57) ABSTRACT

A calcium-bearing magnesium and rare earth element alloy consists essentially of, in mass percent, zinc (Zn): 1-3%; aluminum (Al): 1-3%; calcium (Ca): 0.1-0.4%; gadolinium
(Continued)

(Gd): 0.1-0.4%; yttrium (Y): 0-0.4%; manganese (Mn): 0-0.2%; and balance magnesium (Mg).

20 Claims, 11 Drawing Sheets

(51) Int. Cl.

| | |
|---|---|
| ***B21B 27/02*** | (2006.01) |
| ***B21J 1/02*** | (2006.01) |
| ***C22C 1/03*** | (2006.01) |
| ***C22C 23/04*** | (2006.01) |
| ***C22F 1/06*** | (2006.01) |
| ***B21B 1/22*** | (2006.01) |
| ***B21B 1/38*** | (2006.01) |

(52) U.S. Cl.
CPC ..... *C22C 1/03* (2013.01); *C22C 23/04* (2013.01); *C22F 1/06* (2013.01); *B21B 2001/028* (2013.01); *B21B 2001/225* (2013.01); *B21B 2001/386* (2013.01)

(58) Field of Classification Search
CPC ..... B21B 2001/028; B21B 2001/225; B21B 2001/386; B21J 1/02; C22F 1/06
See application file for complete search history.

(56) References Cited

U.S. PATENT DOCUMENTS

2004/0040635 A1* 3/2004 Guan ..... C22C 23/02 148/557
2005/0095166 A1 5/2005 Saikawa
2006/0231173 A1* 10/2006 Liang ..... B22D 11/16 148/557
2008/0304997 A1* 12/2008 Kim ..... C22C 23/02 420/406
2011/0192500 A1 8/2011 Uggowitzer et al.
2012/0276402 A1* 11/2012 Kitamura ..... C22C 23/02 428/603
2013/0199677 A1* 8/2013 Venkatesan ..... C22C 23/04 148/557
2013/0209309 A1 8/2013 Lee et al.
2013/0220496 A1* 8/2013 Inoue ..... C22F 1/06 148/557
2013/0333809 A1* 12/2013 Kawabe ..... B22D 11/0622 148/420
2014/0236284 A1 8/2014 Stinson
2014/0248288 A1 9/2014 Kumta et al.
2016/0024629 A1* 1/2016 Liang ..... C22F 1/06 148/557
2016/0251934 A1 9/2016 Walton et al.

FOREIGN PATENT DOCUMENTS

CN 104651689 A * 5/2015
KR 2013012662 2/2013
KR 20150033811 A * 4/2015
WO WO 2016/161565 10/2016

OTHER PUBLICATIONS

Rooy, ASM Handbook: Properties and Selection: Nonferrous Alloys and Special-Purpose Materials: Introduction to Aluminum and Aluminum Alloys, 1990, ASM, vol. p. 3-14 (Year: 1990).*
Kraft et al., ASM Handbook: Metalworking: Bulk Forming : Conventional Hot Extrusion, 2005, ASM, vol. 14A , p. 421-439 (Year: 2005).*
International Searching Authority: International Search Report and Written Opinion, App. No. PCT/US2017/050913 (dated Nov. 22, 2017).
International Searching Authority: Preliminary Report on Patentability, App. No. PCT/US2017/050913 (dated Jul. 25, 2019).

* cited by examiner

CALCIUM-BEARING MAGNESIUM AND RARE EARTH ELEMENT ALLOY AND METHOD FOR MANUFACTURING THE SAME

PRIORITY

This application claims priority from Chinese Patent Application No. 201710020396X titled "Ca-Bearing Mg-RE Alloy Sheet with Superior RT formability and Its Preparation Process," which was filed on Jan. 11, 2017 and PCT Patent Application No. PCT/US2017/050913, which was filed on Sep. 11, 2017.

FIELD

This application relates to magnesium alloys and, more particularly, to calcium-bearing magnesium and rare earth element alloys and, even more particularly, to calcium-bearing magnesium and rare earth element alloy sheets with superior room temperature formability.

BACKGROUND

Magnesium alloys have a series of advantages, such as high specific strength, high specific stiffness, good damping performance and good magnetic-shielding performance. Furthermore, magnesium alloys are readily recyclable and are commonly referred to as the green engineering material in the 21st century. Therefore, magnesium alloys may find particular utility in the aerospace, automobile and electronic industries.

However, since magnesium alloys have a hexagonal close packed structure and, therefore, less slip plane, the room temperature formability of magnesium alloy sheets is poor, and to a certain extent limits the application of magnesium alloy sheets. The formability of a sheet is mainly characterized by its Erichsen index (IE value). The Erichsen cupping test of a metallic sheet, which combines the process features of tension and bulging, is an important testing method for measuring the sheet formability and, therefore, has become a standard test for measuring the formability of a material. The higher the IE value of a metallic sheet, the better the formability.

To a certain extent, some advanced preparation or processing methods, such as equal channel angular pressing (ECAP), cross rolling (CR), accumulative roll bonding (ARB), differential speed rolling (DSR) and the like, could create a weak texture and improve the formability of magnesium alloys. However, these methods have low efficiencies in production compared with the conventional rolling method.

Accordingly, those skilled in the art continue with research and development efforts in the field of magnesium alloys.

SUMMARY

Disclosed are calcium-bearing magnesium and rare earth element alloys with high formability and method for manufacturing the same. The disclosed calcium-bearing magnesium and rare earth element alloys may exhibit higher room temperature formability, as well as excellent mechanical properties, better anti-flammability and better corrosion resistance performance.

In one embodiment, the disclosed calcium-bearing magnesium and rare earth element alloy consists essentially of, in mass percent:

Zinc (Zn): 1-3%;
Aluminum (Al): 1-3%;
Calcium (Ca): 0.1-0.4%;
Gadolinium (Gd): 0.1-0.4%; and
the balance is essentially magnesium (Mg) and impurities.

In another embodiment, the disclosed calcium-bearing magnesium and rare earth element alloy consists essentially of, in mass percent:

Zinc (Zn): 1-3%;
Aluminum (Al): 1-3%;
Calcium (Ca): 0.1-0.4%;
Gadolinium (Gd): 0.1-0.4%;
Yttrium (Y): 0-0.4%;
Manganese (Mn): 0-0.2%;
the balance is essentially magnesium (Mg) and impurities.

In yet another embodiment, the disclosed calcium-bearing magnesium and rare earth element alloy consists essentially of, in mass percent:

Zinc (Zn): 1-2%;
Aluminum (Al): 1-2%;
Calcium (Ca): 0.1-0.2%;
Gadolinium (Gd): 0.1-0.2%;
Yttrium (Y): 0.1-0.2%;
Manganese (Mn): 0-0.2%; and
the balance is essentially magnesium (Mg) and impurities.

Also disclosed are methods for manufacturing the disclosed calcium-bearing magnesium and rare earth element alloys. In one embodiment, the disclosed manufacturing method includes the following steps:

Step 1: burdening: weighting raw materials according to the designed composition, wherein the raw materials are magnesium ingot of no less than 99.99 mass percent, aluminum ingot of no less than 99.9 mass percent, zinc ingot of no less than 99.99 mass percent, master alloy of magnesium and calcium, master alloy of magnesium and gadolinium, master alloy of magnesium and yttrium, and master alloy of magnesium and manganese;

Step 2: melting and casting: charging the raw materials into a vacuum induction melting furnace, and heating up to 750° C. for 10 to 15 minutes; then magnesium alloy ingot is produced via semi continuous direct-chill casting or permanent mold casting;

Step 3: solid solution treatment: keeping the magnesium alloy ingot obtained in Step 2 at the temperature of 300 to 450° C. for 12 to 24 hours, and then air-cooling to room temperature;

Step 4: preparation of sheet: subjecting the magnesium alloy ingot after the solid solution treatment to hot rolling, or extrusion followed by hot rolling, or isothermal forging followed by hot rolling, or the like processes, and then cutting the defects at the head, tail and edge to obtain a hot rolled magnesium alloy sheet;

Step 5: annealing: subjecting the hot rolled sheet obtained in Step 4 to annealing treatment at 300 to 350° C. for 30 to 60 minutes.

Further, after the raw materials are completely melted during melting and casting in Step 2, an electromagnetic, mechanical or gas stirring is performed for about 5 to 10 minutes.

Further, the hot rolling process in the Step 4 is: the magnesium alloy slab is hot rolled at 400 to 450° C. in multiple passes, wherein the total reduction in thickness by the hot rolling is 90 percent, and the thickness reductions are within 15 percent for the first two passes, within 10 to 30 percent for the other passes, and within 8 to 18 percent for the last two passes. Between each pass, the slab is kept at required temperature for 5 to 8 minutes.

Further, the extrusion followed by hot rolling process in the Step 4 is: magnesium alloy billet is extruded into a magnesium alloy plates (5 to 20 mm in thickness) or rod (Φ20 to 25 mm) at 250 to 350° C., wherein the extrusion ratio is (16-23):1, and the extrusion rate is 0.5 to 3 mm/s; Further, the extruded magnesium alloy rod or sheet is hot rolled into a thin sheet with a thickness of 1 mm at 400 to 450° C., wherein the thickness reductions are controlled within 20 percent for the first two passes, within 15 to 35 percent for other passes, and within 10 to 25 percent for the last two passes. Between each pass, the work piece is kept at required temperature for 5 to 8 minutes.

Further, the isothermal forging followed by hot rolling process in the Step 4 is: magnesium alloy billet is isothermally forged into thin round billet of a certain size at 300 to 350° C., wherein the total reduction in thickness by forging is about 75 to 85 percent, and the forging rate is 1 to 3 mm/s; Further, the magnesium alloy billet after isothermal forging is hot rolled into a thin plate with a thickness of 1 mm at 400 to 450° C., wherein the thickness reductions are controlled within 20 percent for the first two passes, within 15 to 35 percent for the other passes, and within 10 to 25 percent for the last two passes. Between each pass, the work piece is kept at required temperature for 5 to 8 minutes.

The addition of Al and Zn may effectively improve the mechanical properties of the magnesium alloy. The addition of Ca, Gd and Y may not only improve the mechanical properties of the magnesium alloy, but may also greatly improve the room temperature formability of the magnesium alloy. The addition of an appropriate amount of Mn may eliminate the impurity element Fe, which may effectively purify the magnesium alloy melt, and improve the corrosion-resistance of the magnesium alloy. At the same time, the addition of Ca, Gd and Y may effectively increase the ignition point of the magnesium alloy and improve the flame resistance thereof. Finally, the disclosed preparation process, such as rolling, extrusion followed by rolling, isothermal forging followed by rolling, and the like, may further improve performance and reduce costs.

DETAILED DESCRIPTION

Figure 1:
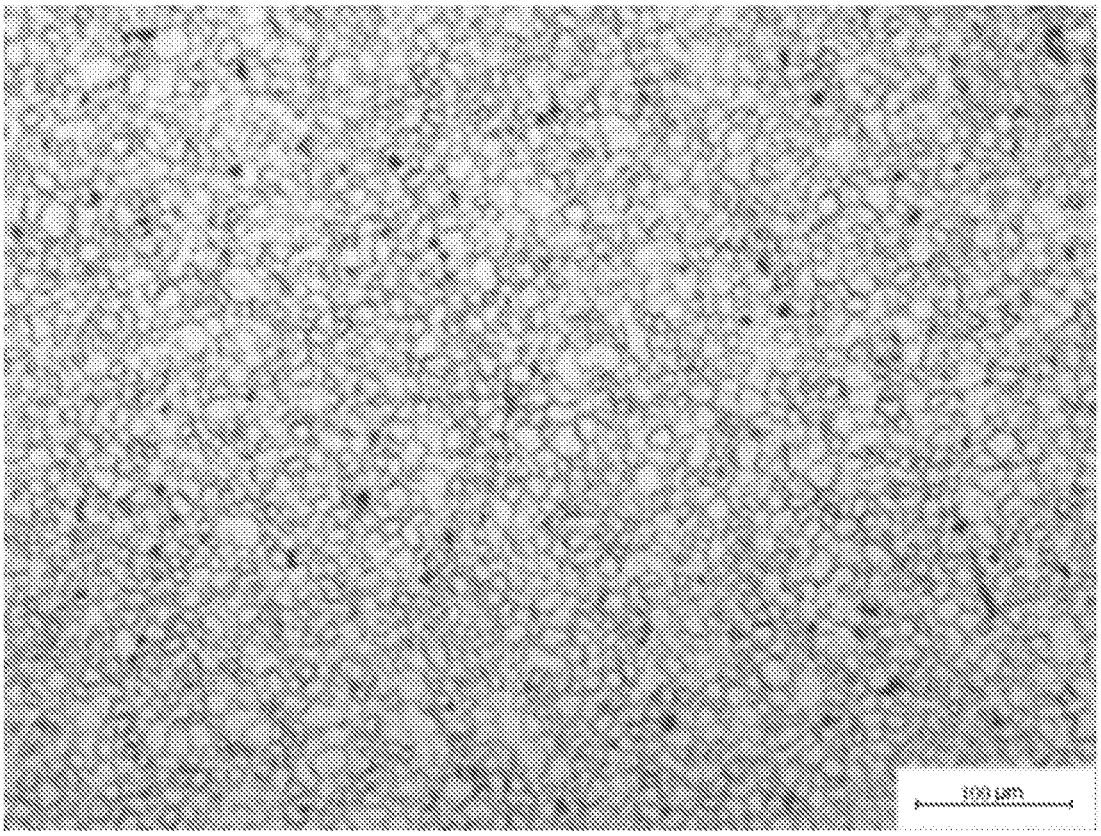
FIG. 1 is a microstructure photograph of the rolled and annealed $Mg_{96.6}Al_2Zn_1Ca_{0.2}Gd_{0.2}$ magnesium alloy sheet (1 mm in thickness) of Example 1 disclosed herein.

It has now been discovered that optimizing a magnesium alloy composition by adding alkaline earth and rare earth elements that can weaken the basal plane texture of magnesium alloys, in combination with conventional rolling, is an economical and effective way to improve the room temperature formability of magnesium alloys.

Furthermore, since magnesium is very reactive with a standard electrode potential of −2.37V, which is the lowest in all the structural metals, it acts as an anode relative to other structural metals and easily reacts with a second phase or impurity elements to cause galvanic corrosion. The oxidative films naturally formed on the surfaces of magnesium alloys are porous, which could not provide sufficient protection for the metal matrix and, therefore, magnesium alloys are not suitable for most of the corrosive environments. This poor corrosion resistance seriously restricts the application of magnesium alloys. However, without being limited to any particular theory, it is believed that addition of rare earth elements to magnesium alloys, as disclosed herein, can effectively improve the corrosion resistance of magnesium alloys.

Still furthermore, magnesium alloys can be easy to ignite, which leads to poor anti-flammability. However, without being limited to any particular theory, it is believed that addition of rare earth elements, as disclosed herein, can improve the anti-flammability of magnesium alloys due to their affinity for oxygen and the formed REO film could effectively prevent the continuous burning of magnesium alloys. Additionally, rare earth elements and alkaline earth metal elements have significant effect on increasing the ignition point of magnesium alloys.

Thus, the optimization of alloy composition by the addition of alkaline earth and rare earth metal elements, further in combination with the optimized extrusion, rolling, isothermal forging process, etc., may not only improve the mechanical properties, the room temperature formability, flame resistance, corrosion resistance and like properties of magnesium alloys, but may also have a lower cost compared to equal channel angular pressing, differential speed rolling and like preparation processes.

In one embodiment, the disclosed calcium-bearing magnesium and rare earth element alloy has the composition shown in Table 1.

TABLE 1

| Element | Quantity |
|---|---|
| Zinc | 1-3 wt % |
| Aluminum | 1-3 wt % |
| Calcium | 0.1-0.4 wt % |
| Gadolinium | 0.1-0.4 wt % |
| Yttrium | 0-0.4 wt % |
| Manganese | 0-0.2 wt % |
| Magnesium | Balance |

While magnesium forms the balance (essentially) of the calcium-bearing magnesium and rare earth element alloy of Table 1, those skilled in the art will appreciate that impurities may be present.

The calcium-bearing magnesium and rare earth element alloy of Table 1, in sheet form, has a tensile strength of 245.0 to 280.0 MPa, an elongation to failure of 18.0 to 32.0 percent, and an IE value of 4.5 to 7.0.

In another embodiment, the disclosed calcium-bearing magnesium and rare earth element alloy has the composition shown in Table 2.

TABLE 2

| Element | Quantity |
|---|---|
| Zinc | 1-2 wt % |
| Aluminum | 1-2 wt % |
| Calcium | 0.1-0.2 wt % |
| Gadolinium | 0.1-0.2 wt % |
| Yttrium | 0-0.2 wt % |
| Manganese | 0-0.2 wt % |
| Magnesium | Balance |

While magnesium forms the balance (essentially) of the calcium-bearing magnesium and rare earth element alloy of Table 2, those skilled in the art will appreciate that impurities may be present.

Aluminum at 1 to 2 mass percent may effectively strengthen the magnesium alloy, improve the rollability and improve the corrosion resistance. Zinc at 1 to 2 mass percent may have a function of solid solution strengthening, and may form a second phase particle with elements Mg, Gd, etc., and may play a role of precipitation strengthening. Calcium at 0.1 to 0.2 mass percent not only could refine grain and strengthen the magnesium alloy, but also may improve the annealed texture of the alloy. Gadolinium at 0.1 to 0.2 mass percent may enhance the strength and ductility of the magnesium alloy, weaken the basal plane texture, and improve the formability of the magnesium alloy sheet. Yttrium at 0 to 0.2 mass percent may effectively enhance the strength of the magnesium alloy sheet. Manganese at 0 to 0.2 mass percent may improve the corrosion resistance of the magnesium alloy. A low content of alloy elements, in particular the low content of rare earth elements, in combination with the conventional preparation process, greatly reduces the preparation cost of the disclosed magnesium alloy.

In one embodiment, the disclosed calcium-bearing magnesium and rare earth element alloys may be manufactured as follows.

Step 1: burdening: weighting raw materials according to the designed composition, wherein the raw materials are magnesium ingot of no less than 99.99 mass percent, aluminum ingot of no less than 99.9 mass percent, zinc ingot of no less than 99.99 mass percent, master alloy of magnesium and calcium, master alloy of magnesium and gadolinium, master alloy of magnesium and yttrium, and master alloy of magnesium and manganese.

Step 2: melting and casting: charging the raw materials into a vacuum induction melting furnace, and heating up to 750° C. for 10 to 15 minutes; then the magnesium alloy ingot is produced via semi-continuous direct-chill casting or permanent mold casting.

Step 3: solid solution treatment: keeping the magnesium alloy ingot obtained in Step 2 at a temperature of 300 to 450° C. for 12 to 24 hours, and then air-cooling to room temperature.

Step 4: preparation of sheet: subjecting the magnesium alloy ingot after the solid solution treatment to hot rolling, or extrusion followed by hot rolling, or isothermal forging followed by hot rolling, or like processes, and then cutting the defects at the head, tail and edge to obtain a hot rolled magnesium alloy sheet with good shape.

Step 5: annealing: subjecting the hot rolled sheet obtained in Step 4 to annealing treatment at 350° C. for 30 to 60 minutes.

EXAMPLES

Example 1

$Mg_{96.6}Al_2Zn_1Ca_{0.2}Gd_{0.2}$ magnesium alloy sheet (1 mm in thickness): weighting raw materials according to the designed composition, wherein the raw materials were: magnesium ingot of 99.99 mass percent, aluminum ingot of 99.9 mass percent, zinc ingot of 99.99 mass percent, master alloy of magnesium and calcium of 30 mass percent, and master alloy of magnesium and gadolinium of 30 mass percent. The burdening was carried out, according to the nominal composition of the magnesium alloy, and also in consideration of the thermal loss of elements.

Melting and casting of $Mg_{96.6}Al_2Zn_1Ca_{0.2}Gd_{0.2}$. The raw materials were charged into a crucible in a vacuum induction melting furnace and the melting furnace was vacuumed and heated under inert atmosphere. The temperature was increased to 750° C. and maintained for 15 minutes. After the raw materials were completely melted, the melts were electromagnetically stirred for about 8 minutes. Finally, the melts were poured into the graphite crucible and placed in the air to cool, giving an ingot.

Solid solution treatment of $Mg_{96.6}Al_2Zn_1Ca_{0.2}Gd_{0.2}$. The magnesium alloy ingot was placed in a resistance furnace and kept at 450° C. for 12 hours, and then air-cooled to room temperature.

Hot rolling of $Mg_{96.6}Al_2Zn_1Ca_{0.2}Gd_{0.2}$. The magnesium alloy ingot after the solid solution treatment was wire-cut into a slab having a thickness of 10 mm, and then the surface of the slab was polished for hot rolling. The specific hot rolling process was as follows: the slab was kept at 450° C. for about 30 minutes and then was hot rolled. The total reduction in thickness by hot rolling was 90 percent, that is, the final thickness of sheet was 1 mm. The thickness reductions of the first two passes was 8 percent and 10 percent, respectively, and the thickness reductions of other passes were controlled within 10 to 30 percent, wherein the thickness reductions of the last two passes were 15 percent and 10 percent, respectively. Due to the fast heat dissipation of the magnesium alloy, in order to stabilize the temperature during the rolling, the sample was kept at 450° C. for 5 minutes in the resistance furnace after each rolling pass.

After the hot rolling, the defects at head, tail and edge of the hot rolled sheet were cut to obtain a hot rolled magnesium alloy sheet.

Annealing of the hot rolled $Mg_{96.6}Al_2Zn_1Ca_{0.2}Gd_{0.2}$ sheet. The finally rolled sheet was placed into a resistance furnace and kept at 350° C. for 60 minutes.

The $Mg_{96.6}Al_2Zn_1Ca_{0.2}Gd_{0.2}$ sheet has a yield strength of 231 MPa, a tensile strength of 260 MPa, an elongation to failure of 21 percent and an IE value of 5.87, and has an average corrosion rate of 0.2987 mg/cm$^2$/d after 5 days salt spray test with 3.5 percent NaCl neutral solution (pH=7) at 25° C. The microstructure photograph of this sheet after rolling and annealing is shown in FIG. 1.

Example 2

$Mg_{96.6}Al_2Zn_1Ca_{0.2}Gd_{0.2}$ magnesium alloy sheet (5 mm in thickness): the same burdening, melting and casting, and solid solution treatment processes of $Mg_{96.6}Al_2Zn_1Ca_{0.2}Gd_{0.2}$ as in Example 1 was carried out.

Hot rolling of $Mg_{96.6}Al_2Zn_1Ca_{0.2}Gd_{0.2}$. The magnesium alloy ingot after the solid solution treatment was wire-cut into a slab having a thickness of 30 mm, and then the surface of the slab was polished for hot rolling. The specific hot rolling process was as follows: the slab was kept at 450° C. for about 50 minutes and then was hot rolled. The total thickness reduction by hot rolling was 83.3 percent, that is, the final thickness of the sheet was 5 mm. The thickness reductions of the first two passes were 8 percent and 10 percent, respectively, and the thickness reductions of other passes were controlled within 10 to 30 percent, wherein the thickness reductions of the last two passes were 15 percent and 10 percent, respectively. Due to the fast heat dissipation of the magnesium alloy, in order to stabilize the temperature during the rolling, the sample was kept at 450° C. for 5 to 8 minutes in the resistance furnace after each rolling pass. After the hot rolling, the defects at head, tail and edges of the hot rolled sheet were cut to obtain a hot rolled magnesium alloy sheet with good shape.

Annealing of the hot rolled $Mg_{96.6}Al_2Zn_1Ca_{0.2}Gd_{0.2}$ sheet. The finally rolled sheet was placed into a resistance furnace and kept at 350° C. for 60 minutes.

Figure 2:
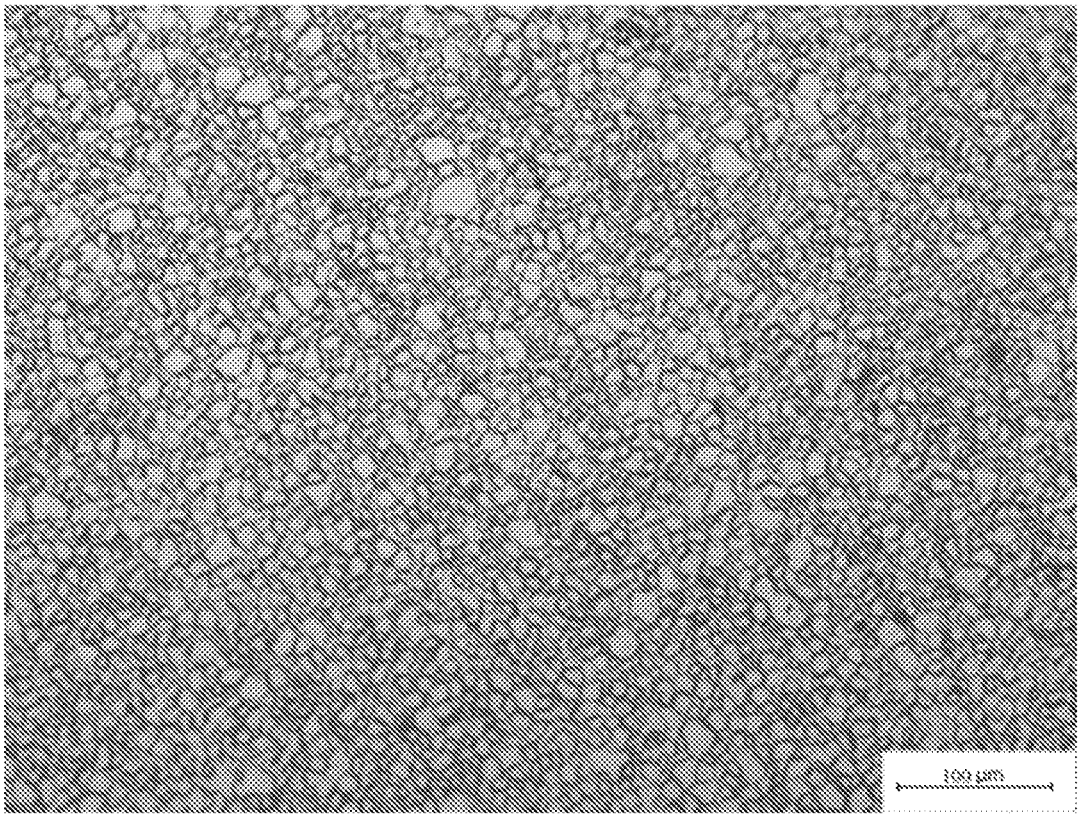
FIG. 2 is a microstructure photograph of the rolled and annealed $Mg_{96.6}Al_2Zn_1Ca_{0.2}Gd_{0.2}$ magnesium alloy sheet (5 mm in thickness) of Example 2 disclosed herein.

The $Mg_{96.6}Al_2Zn_1Ca_{0.2}Gd_{0.2}$ sheet has a yield strength of 167 MPa, a tensile strength of 245 MPa, and an elongation to failure of 18 percent. The microstructure photograph of this sheet after rolling and annealing is shown in FIG. 2.

Example 3

$Mg_{96.6}Al_2Zn_1Ca_{0.2}Gd_{0.2}$ magnesium alloy sheet (1 mm in thickness): the same burdening, melting and casting, and solid solution treatment processes of $Mg_{96.6}Al_2Zn_1Ca_{0.2}Gd_{0.2}$ as in Example 1 was carried out.

Isothermal forging of $Mg_{96.6}Al_2Zn_1Ca_{0.2}Gd_{0.2}$. The magnesium ingot after the solid solution treatment was cut into a cylindrical billet (Φ 140 mm×110 mm), and then the billet was isothermally forged into a round billet having a thickness of 20 mm at 350° C., wherein the forging rate was 1 mm/s, and the total reduction by forging was about 80 percent.

Hot rolling of $Mg_{96.6}Al_2Zn_1Ca_{0.2}Gd_{0.2}$. The round billet obtained by isothermal forging was wire-cut into a slab having a thickness of 10 mm, and then the surface of the slab was polished for hot rolling. The specific hot rolling process was as follows: the slab was kept at 400° C. for about 30 minutes and then was hot rolled. The total reduction in thickness by hot rolling was 95 percent, that is, the final thickness of sheet was 1 mm. The thickness reductions of the first two passes were 10 percent and 15 percent, respectively, and thickness reductions of other passes were controlled within 15 to 35 percent, wherein the thickness reductions of the last two passes were 20 percent and 15 percent, respectively. Due to the fast heat dissipation of the magnesium alloy, in order to stabilize the temperature during the rolling, the sample was kept at 450° C. for 5 minutes in the resistance furnace after each rolling pass. After the hot rolling, the defects at head, tail and edges of the hot rolled sheet were cut in order to obtain a hot rolled magnesium alloy sheet.

Annealing of the hot rolled $Mg_{96.6}Al_2Zn_1Ca_{0.2}Gd_{0.2}$ sheet. Finally, the rolled sheet was placed into a resistance furnace and kept at 350° C. for 60 minutes.

Figure 3:
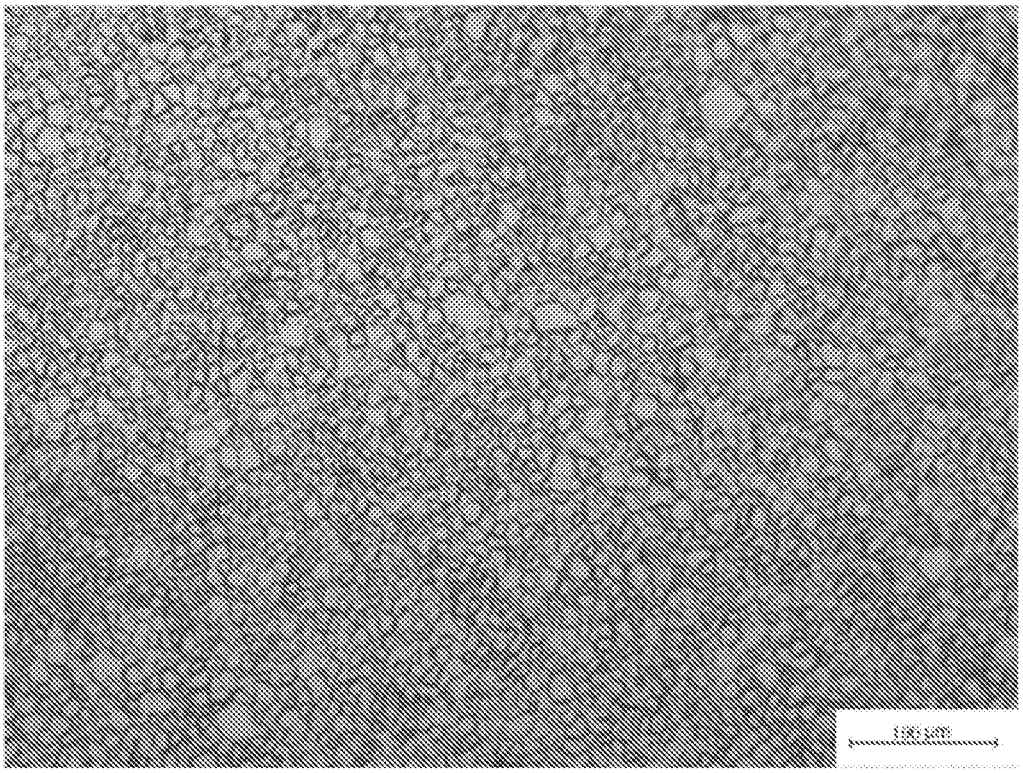
FIG. 3 is a microstructure photograph of the isothermally forged, rolled and annealed $Mg_{96.6}Al_2Zn_1Ca_{0.2}Gd_{0.2}$ magnesium alloy sheet (1 mm in thickness) of Example 3 disclosed herein.

$Mg_{96.6}Al_2Zn_1Ca_{0.2}Gd_{0.2}$ sheet has a yield strength of 231 MPa, a tensile strength of 249 MPa, an elongation to failure of 23 percent and an IE value of 5.51. The microstructure photograph of this sheet after rolling and annealing is shown in FIG. 3.

Example 4

$Mg_{96.6}Zn_2Al_1Ca_{0.2}Gd_{0.2}$ sheet (1 mm in thickness): weighting raw materials according to the designed composition, wherein the raw materials were: magnesium ingot of 99.99 mass percent, aluminum ingot of 99.9 mass percent, zinc ingot of 99.99 mass percent, master alloy of magnesium and calcium of 30 mass percent, and master alloy of magnesium and gadolinium of 30 mass percent. The burdening was carried out, according to the nominal composition of the magnesium alloy, and also in consideration of the thermal loss of each of elements.

Melting and casting of $Mg_{96.6}Zn_2Al_1Ca_{0.2}Gd_{0.2}$. The raw materials were charged into a crucible in a vacuum induction melting furnace and the melting furnace was vacuumed and heated under inert atmosphere. The temperature was increased to 750° C. and maintained for 15 minutes. After the raw materials were completely melted, the melts were electromagnetically stirred for about 8 minutes. Finally, the melts were poured into the graphite crucible and placed in the air to cool, giving an ingot.

Solid solution treatment of $Mg_{96.6}Zn_2Al_1Ca_{0.2}Gd_{0.2}$. The magnesium alloy ingot was placed in a resistance furnace and kept at 300° C. for 20 hours, and then air-cooled to room temperature.

Hot rolling of $Mg_{96.6}Zn_2Al_1Ca_{0.2}Gd_{0.2}$. The magnesium alloy ingot after the solid solution treatment was wire-cut into a slab having a thickness of 10 mm, and then the surface of the slab was polished for hot rolling. The specific hot rolling process was as follows: the slab was kept at 400° C. for about 30 minutes and then was hot rolled. The total thickness reduction by hot rolling was 90 percent, that is, the final thickness of sheet was 1 mm. The thickness reductions of the first two passes were 8 percent and 10 percent, respectively, and the thickness reductions of the other passes were controlled within about 10 to 30 percent, wherein the thickness reductions of the last two passes were 15 percent and 10 percent, respectively. Due to the fast heat dissipation of the magnesium alloy, in order to stabilize the rolling temperature, the sample was kept at 400° C. for 5 minutes in the resistance furnace after each rolling pass. After the hot rolling, the defects at head, tail and edges of the hot rolled sheet were cut to obtain a hot rolled magnesium alloy sheet with good shape.

Annealing of the hot rolled $Mg_{96.6}Zn_2Al_1Ca_{0.2}Gd_{0.2}$ sheet. The finally rolled sheet was placed into a resistance furnace and kept at 350° C. for 45 minutes.

Figure 4:
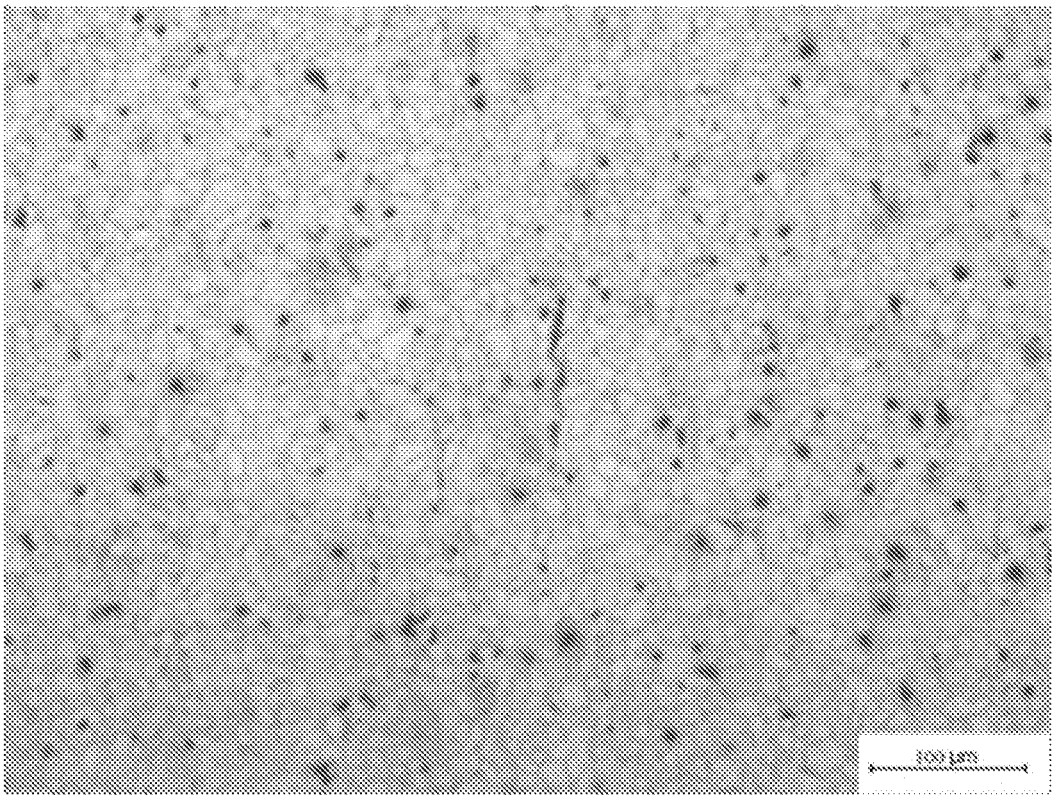
FIG. 4 is a microstructure photograph of the rolled and annealed $Mg_{96.6}Zn_2Al_1Ca_{0.2}Gd_{0.2}$ magnesium alloy sheet (1 mm in thickness) of Example 4 disclosed herein.

The $Mg_{96.6}Zn_2Al_1Ca_{0.2}Gd_{0.2}$ sheet has a yield strength of 145 MPa, a tensile strength of 245 MPa, an elongation to failure of 26 percent and an IE value of 6.38. The microstructure photograph of this sheet after rolling and annealing is shown in FIG. 4. This sheet has an average corrosion rate of 0.2943 mg/cm$^2$/d of 5 days, in 3.5 percent NaCl neutral solution (pH=7) at 25° C. when the salt spray falling rate is 0.013 ml/cm$^2$/h.

Example 5

$Mg_{96.6}Zn_2Al_1Ca_{0.2}Gd_{0.2}$ sheet (5 mm in thickness): the same burdening, melting and casting, and solid solution treatment processes of $Mg_{96.6}Zn_2Al_1Ca_{0.2}Gd_{0.2}$ as in Example 4 was carried out.

Hot rolling of $Mg_{96.6}Zn_2Al_1Ca_{0.2}Gd_{0.2}$. The magnesium alloy ingot after the solid solution treatment was wire-cut into a slab having a thickness of 30 mm, and then the surface of the slab was polished for hot rolling. The specific hot rolling process was as follows: the slab was kept at 400° C. for about 30 minutes and then was hot rolled. The total thickness reduction by hot rolling was 83.3 percent, that is, the final thickness of sheet was 5 mm. The thickness reductions of the first two passes were 8 percent and 10 percent, respectively, and the thickness reductions of the other passes were controlled within about 10 to 30 percent, wherein the thickness reductions of the last two passes were 15 percent and 10 percent, respectively. Due to the fast heat dissipation of the magnesium alloy, in order to stabilize the temperature during the rolling, the sample was kept at 400° C. for 5 to 8 minutes in the resistance furnace after each rolling pass was complete. After the hot rolling was complete, the defects at head, tail and edges of the hot rolled sheet were cut to obtain a hot rolled magnesium alloy sheet with good shape.

Annealing of the hot rolled $Mg_{96.6}Zn_2Al_1Ca_{0.2}Gd_{0.2}$ sheet. The finally rolled sheet was placed into a resistance furnace and kept at 350° C. for 45 minutes.

Figure 5:
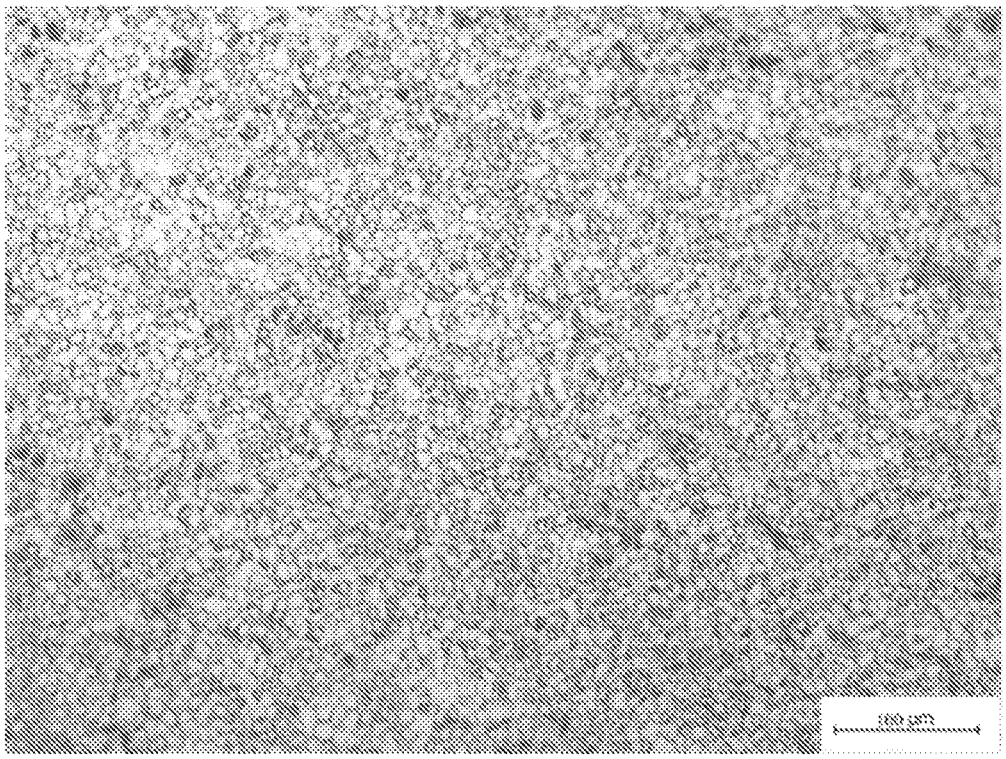
FIG. 5 is a microstructure photograph of the rolled and annealed $Mg_{96.6}Zn_2Al_1Ca_{0.2}Gd_{0.2}$ magnesium alloy sheet (5 mm in thickness) of Example 5 disclosed herein.

The $Mg_{96.6}Zn_2Al_1Ca_{0.2}Gd_{0.2}$ sheet has a yield strength of 227 MPa, a tensile strength of 250 MPa, and an elongation to failure of 23 percent. The microstructure photograph of this sheet after rolling and annealing is shown in FIG. 5.

Example 6

$Mg_{96.6}Zn_2Al_1Ca_{0.2}Gd_{0.2}$ sheet (1 mm in thickness): the same burdening, melting and casting, and solid solution treatment processes of $Mg_{96.6}Zn_2Al_1Ca_{0.2}Gd_{0.2}$ as in Example 4 was carried out.

Extrusion of $Mg_{96.6}Zn_2Al_1Ca_{0.2}Gd_{0.2}$. The magnesium alloy ingot after the solid solution treatment was wire-cut into a cylindrical billet (c 120 mm×110 mm), and then the billet was extruded into a magnesium alloy sheet (90×6 mm) at 250° C., wherein the extrusion ratio was about 20:1, and the extrusion rate was 1 mm/s.

Hot rolling of $Mg_{96.6}Zn_2Al_1Ca_{0.2}Gd_{0.2}$. The magnesium alloy slab after the extrusion was polished for hot rolling. The specific hot rolling process was as follows: the slab was kept at 400° C. for about 30 minutes and then was hot rolled. The total thickness reduction by hot rolling was 83 percent, that is, the final thickness of sheet was 1 mm. The thickness reductions of the first two passes were 10 percent and 15 percent, respectively, and the thickness reductions of other passes were controlled within about 15 to 30 percent, wherein the thickness reductions of the last two passes were 20 percent and 15 percent, respectively. Due to the fast heat dissipation of the magnesium alloy, in order to stabilize the temperature during the rolling, the sample was kept at 400° C. for 5 minutes in the resistance furnace after each rolling pass was complete. After the hot rolling was complete, the defects at head, tail and edges of the hot rolled sheet were cut to obtain a hot rolled magnesium alloy sheet with good shape.

Annealing of the hot rolled $Mg_{96.6}Zn_2Al_1Ca_{0.2}Gd_{0.2}$ sheet. The finally rolled sheet was placed into a resistance furnace and kept at 350° C. for 60 minutes.

Figure 6:
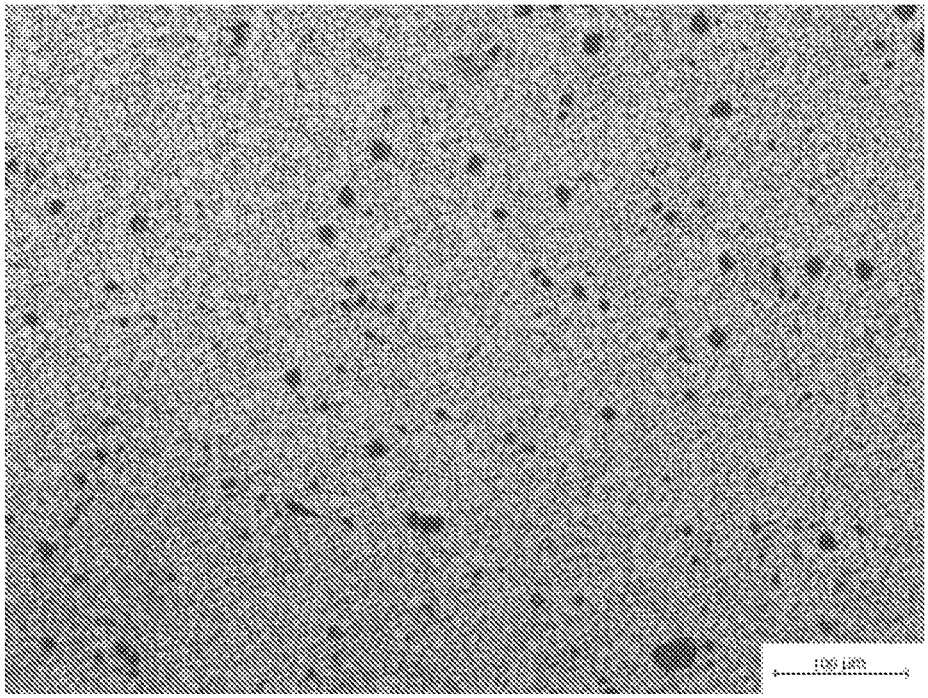
FIG. 6 is a microstructure photograph of the extruded, rolled and annealed $Mg_{96.6}Zn_2Al_1Ca_{0.2}Gd_{0.2}$ magnesium alloy sheet (1 mm in thickness) of Example 6 disclosed herein.

The $Mg_{96.6}Zn_2Al_1Ca_{0.2}Gd_{0.2}$ sheet has a yield strength of 184.8 MPa, a tensile strength of 252.6 MPa, an elongation to failure of 31.4 percent. The microstructure photograph of this sheet after rolling and annealing is shown in FIG. 6.

Example 7

$Mg_{96.6}Zn_2Al_1Ca_{0.2}Gd_{0.2}$ sheet (1 mm in thickness): the same burdening, melting and casting, and solid solution treatment processes of $Mg_{96.6}Zn_2Al_1Ca_{0.2}Gd_{0.2}$ as in Example 4 was carried out.

Isothermal forging of $Mg_{96.6}Zn_2Al_1Ca_{0.2}Gd_{0.2}$. The magnesium ingot after the solid solution treatment was cut into a cylindrical billet (c 140 mm×110 mm), and then the billet was isothermally forged into a round billet having a thickness of 20 mm at 350° C., wherein the forging rate was 1 mm/s, and the total reduction by forging was about 80 percent.

Hot rolling of $Mg_{96.6}Zn_2Al_1Ca_{0.2}Gd_{0.2}$. The round billet obtained by isothermal forging was wire-cut into a slab having a thickness of 10 mm, and then the surface of the slab was polished for hot rolling. The specific hot rolling process was as follows: the slab was kept at 400° C. for about 30 minutes and then was hot rolled. The total thickness reduction by hot rolling was 95 percent, that is, the final thickness of sheet was 1 mm. The thickness reductions of the first two passes were 15 percent and 20 percent, respectively, and the thickness reductions of other passes were controlled within 15%-35%, wherein the thickness reductions of the last two passes were 20 percent and 15 percent, respectively. Due to the fast heat dissipation of the magnesium alloy, in order to stabilize the temperature during the rolling, the sample was kept at 400° C. for 5 minutes in the resistance furnace after each rolling pass. After the hot rolling, the defects at head, tail and edges of the hot rolled sheet were cut to obtain a hot rolled magnesium alloy sheet with good shape.

Annealing of the hot rolled $Mg_{96.6}Zn_2Al_1Ca_{0.2}Gd_{0.2}$ sheet. The finally rolled sheet was placed into a resistance furnace and kept at 350° C. for 60 minutes.

Figure 7:
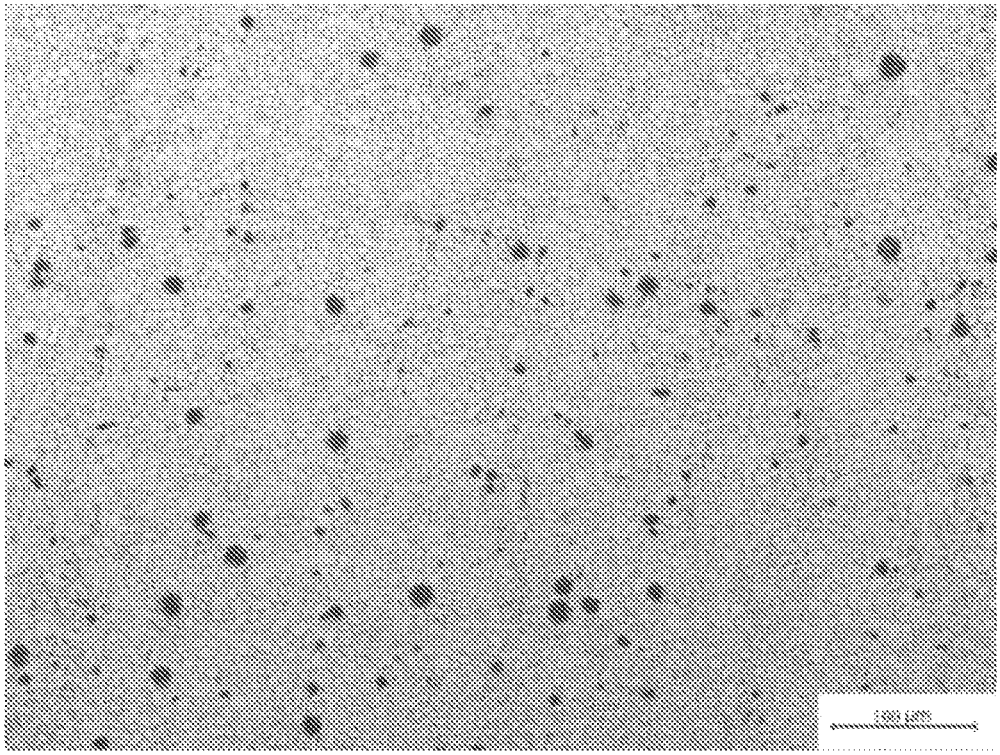
FIG. 7 is a microstructure photograph of the isothermally forged, rolled and annealed $Mg_{96.6}Zn_2Al_1Ca_{0.2}Gd_{0.2}$ magnesium alloy sheet (1 mm in thickness) of Example 7 disclosed herein.

The $Mg_{96.6}Zn_2Al_1Ca_{0.2}Gd_{0.2}$ sheet has a yield strength of 170 MPa, a tensile strength of 255 MPa, an elongation to failure of 24 percent and an IE value of 5.62. The microstructure photograph of this sheet after rolling and annealing is shown in FIG. 7.

Example 8

$Mg_{96.4}Zn_2Al_1Ca_{0.2}Gd_{0.1}Y_{0.1}Mn_{0.2}$ magnesium alloy sheet (1 mm in thickness): weighting raw materials according to the mass percent of composition, wherein the raw materials were: magnesium ingot of 99.99 mass percent, aluminum ingot of 99.9 mass percent, zinc ingot of 99.99 mass percent, master alloy of magnesium and calcium of 30 mass percent, and master alloy of magnesium and gadolinium of 30 mass percent, master alloy of magnesium and manganese of 30 mass percent. The burdening was carried out, according to the nominal composition of the magnesium alloy, and also in consideration of the thermal loss of each of elements.

Melting and casting of $Mg_{96.4}Zn_2Al_1Ca_{0.2}Gd_{0.1}Y_{0.1}Mn_{0.2}$. The raw materials were charged into a crucible in a vacuum induction melting furnace and the melting furnace was vacuumed and heated under inert atmosphere. The temperature was increased to 750° C. and maintained for 15 minutes. After the raw materials were completely melted, the melts were electromagnetically stirred for about 8 minutes. Finally, the melts were poured into the graphite crucible and placed in the air to cool, giving an ingot.

Solid solution treatment of $Mg_{96.4}Zn_2Al_1Ca_{0.2}Gd_{0.1}Y_{0.1}Mn_{0.2}$. The magnesium alloy ingot was placed in a resistance furnace and kept at 300° C. for 12 hours, and then air-cooled to room temperature.

Hot rolling of $Mg_{96.4}Zn_2Al_1Ca_{0.2}Gd_{0.1}Y_{0.1}Mn_{0.2}$. The magnesium alloy ingot after the solid solution treatment was wire-cut into a slab having a thickness of 10 mm, and then the surface of the slab was polished for hot rolling. The specific hot rolling process was as follows: the slab was kept at 400° C. for about 30 minutes and then was hot rolled. The total thickness reduction by hot rolling was 90 percent, that is, the final thickness of sheet was 1 mm. The thickness reductions of the first two passes were 8 percent and 10 percent, respectively, and the thickness reductions of other passes were controlled within 10 to 30 percent, wherein the thickness reductions of the last two passes were 15 percent and 10 percent, respectively. Due to the fast heat dissipation of the magnesium alloy, in order to stabilize the temperature during the rolling, the sample was kept at 400° C. for 5 minutes in the resistance further after each rolling pass. After the hot rolling, the defects at head, tail and edges of the hot rolled sheet were cut to obtain a hot rolled magnesium alloy sheet with good shape.

Annealing of the hot rolled $Mg_{96.4}Zn_2Al_1Ca_{0.2}Gd_{0.1}Y_{0.1}Mn_{0.2}$ sheet. The finally rolled sheet was placed into a resistance furnace and kept at 350° C. for 60 minutes.

Figure 8:
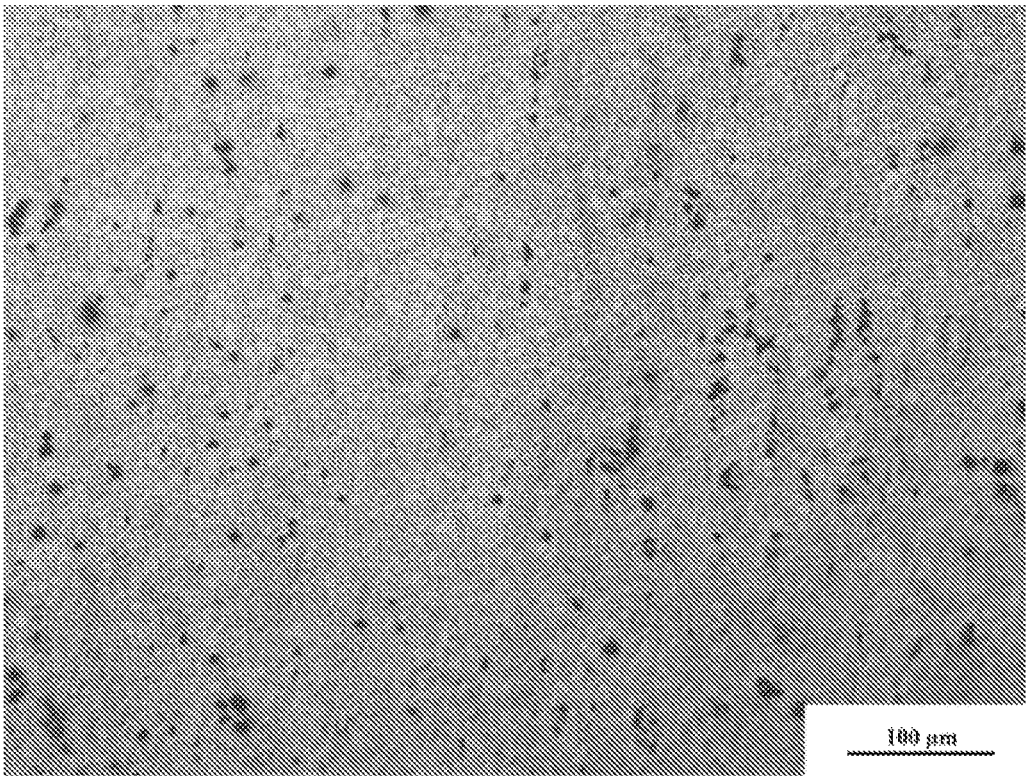
FIG. 8 is a microstructure photograph of the rolled and annealed $Mg_{96.4}Zn_2Al_1Ca_{0.2}Gd_{0.1}Y_{0.1}Mn_{0.2}$ magnesium alloy sheet (1 mm in thickness) of Example 8 disclosed herein.

The $Mg_{96.4}Zn_2Al_1Ca_{0.2}Gd_{0.1}Y_{0.1}Mn_{0.2}$ has a yield strength of 202.8 MPa, a tensile strength of 265.6 MPa, an elongation to failure of 26.6 percent and an IE value of 5.10. The microstructure photograph of this sheet after rolling and annealing is shown in FIG. 8.

Example 9

$Mg_{95}Al_3Zn_1Ca_{0.4}Gd_{0.4}Mn_{0.2}$ magnesium alloy sheet (1 mm in thickness): weighting raw materials according to the mass percent of composition, wherein the raw materials were: magnesium ingot of 99.99 mass percent, aluminum ingot of 99.9 mass percent, zinc ingot of 99.99 mass percent, master alloy of magnesium and calcium of 30 mass percent, master alloy of magnesium and gadolinium of 30 mass percent, and master alloy of magnesium and manganese of 30 mass percent. The burdening was carried out, according to the nominal composition of the magnesium alloy, and also in consideration of the thermal loss of each of elements.

Melting and casting of $Mg_{95}Al_3Zn_1Ca_{0.4}Gd_{0.4}Mn_{0.2}$. The raw materials were charged into a crucible in a vacuum induction melting furnace and the melting furnace was vacuumed and heated under inert atmosphere. The temperature was increased to 750° C. and maintained for 15 minutes. After the raw materials were completely melted, the melts were electromagnetically stirred for about 10 minutes. Finally, the melts were poured into the graphite crucible and placed in the air to cool, giving an ingot.

Solid solution treatment of $Mg_{95}Al_3Zn_1Ca_{0.4}Gd_{0.4}Mn_{0.2}$. The magnesium alloy ingot was placed in a resistance furnace and kept at 450° C. for 12 hours, and then air-cooled to room temperature.

Hot rolling of $Mg_{95}Al_3Zn_1Ca_{0.4}Gd_{0.4}Mn_{0.2}$. The magnesium alloy ingot after the solid solution treatment was wire-cut into a slab having a thickness of 10 mm, and then the surface of the slab was polished for hot rolling. The specific hot rolling process was as follows: the slab was kept at 400° C. for about 30 minutes and then was hot rolled. The total thickness reduction by hot rolling was 90 percent, that is, the final thickness of sheet was 1 mm. The thickness reductions of the first two passes were 8 percent and 10 percent, respectively, and the thickness reductions of other passes were controlled within 10 to 30 percent, wherein thickness reductions of the last two passes were 15 percent and 10 percent, respectively. Due to the fast heat dissipation of the magnesium alloy, in order to stabilize the temperature during the rolling, the sample was kept at 400° C. for 8 minutes in the resistance further after each rolling pass. After the hot rolling, the defects at head, tail and edges of the hot rolled sheet were cut to obtain a hot rolled magnesium alloy sheet with good shape.

Annealing of the hot rolled $Mg_{95}Al_3Zn_1Ca_{0.4}Gd_{0.4}Mn_{0.2}$ sheet. The finally rolled sheet was placed into a resistance furnace and kept at 350° C. for 60 minutes.

Figure 9:
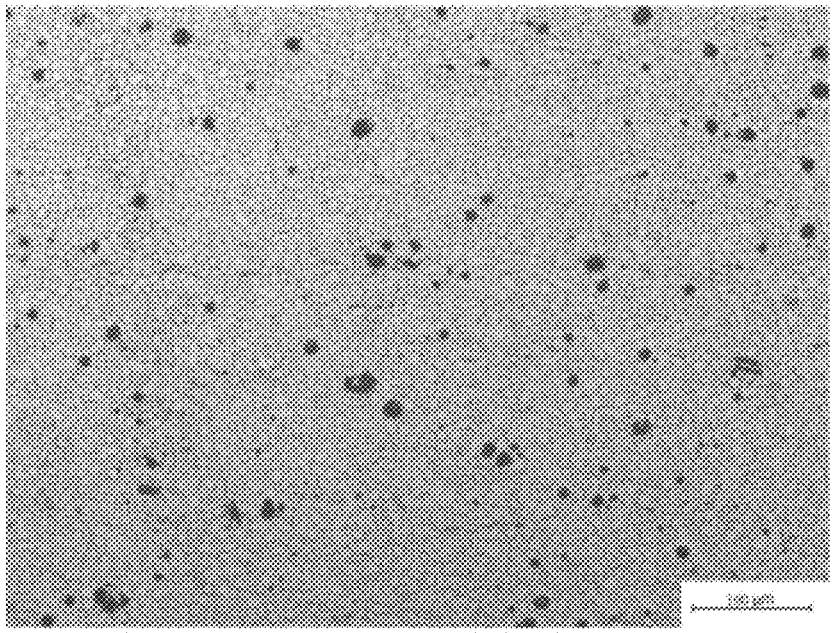
FIG. 9 is a microstructure photograph of the rolled and annealed $Mg_{95}Al_3Zn_1Ca_{0.4}Gd_{0.4}Mn_{0.2}$ magnesium alloy sheet (1 mm in thickness) of Example 9 disclosed herein.

The $Mg_{95}Al_3Zn_1Ca_{0.4}Gd_{0.4}Mn_{0.2}$ sheet has a yield strength of 200 MPa, a tensile strength of 275 MPa, an elongation to failure of 20 percent and an IE value of 5.0. The microstructure photograph of this sheet after rolling and annealing is shown in FIG. 9.

Example 10

$Mg_{95}Al_3Zn_1Ca_{0.4}Y_{0.4}Mn_{0.2}$ magnesium alloy sheet (1 mm in thickness): weighting raw materials according to the mass percent of composition, wherein the raw materials were: magnesium ingot of 99.99 mass percent, aluminum ingot of 99.9 mass percent, zinc ingot of 99.99 mass percent, master alloy of magnesium and calcium of 30 mass percent, master alloy of magnesium and yttrium of 30 mass percent, and master alloy of magnesium and manganese of 30 mass percent. The burdening was carried out, according to the nominal composition of the magnesium alloy, and also in consideration of the thermal loss of each of elements.

Melting and casting of $Mg_{95}Al_3Zn_1Ca_{0.4}Y_{0.4}Mn_{0.2}$. The raw materials were charged into a crucible in a vacuum induction melting furnace and the melting furnace was vacuumed and heated under inert atmosphere. The temperature was increased to 750° C. and maintained for 15 minutes. After the raw materials were completely melted, the melts were electromagnetically stirred for about 10 minutes. Finally, the melts were poured into the graphite crucible and placed in the air to cool, giving an ingot.

Solid solution treatment of $Mg_{95}Al_3Zn_1Ca_{0.4}Y_{0.4}Mn_{0.2}$. The magnesium alloy ingot was placed in a resistance furnace and kept at 450° C. for 15 hours, and then air-cooled to room temperature.

Hot rolling of $Mg_{95}Al_3Zn_1Ca_{0.4}Y_{0.4}Mn_{0.2}$. The magnesium alloy ingot after the solid solution treatment was wire-cut into a slab having a thickness of 10 mm, and then the surface of the slab was polished for hot rolling. The specific hot rolling process was as follows: the slab was kept at 400° C. for about 30 minutes and then was hot rolled. The total thickness reduction by hot rolling was 90 percent, that is, the final thickness of sheet was 1 mm. The thickness reductions of the first two passes were 8 percent and 10 percent, respectively, and the thickness reductions of the other passes were controlled within 10 to 30 percent, wherein the thickness reductions of the last two passes were 15 percent and 10 percent, respectively. Due to the fast heat dissipation of the magnesium alloy, in order to stabilize the rolling temperature, the sample was kept at 400° C. for 8 minutes in the resistance further after each rolling pass. After the hot rolling, the defects at head, tail and edges of the hot rolled sheet were cut to obtain a hot rolled magnesium alloy sheet with good shape.

Annealing of the hot rolled $Mg_{95}Al_3Zn_1Ca_{0.4}Y_{0.4}Mn_{0.2}$ sheet. The finally rolled sheet was placed into a resistance furnace and kept at 350° C. for 60 minutes.

Figure 10:
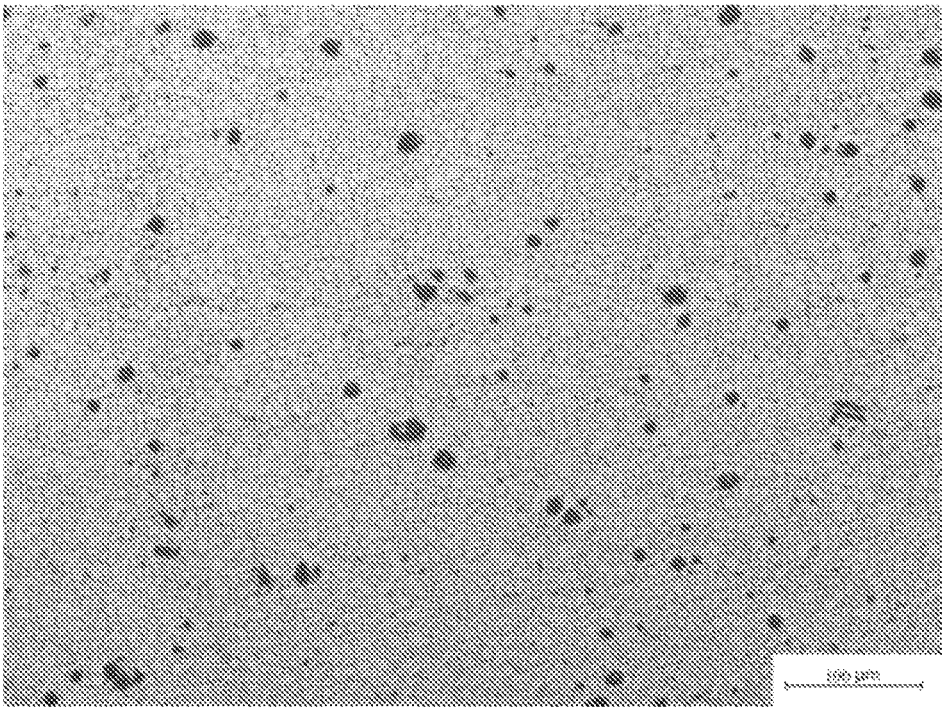
FIG. 10 is a microstructure photograph of the rolled and annealed $Mg_{95}Al_3Zn_1Ca_{0.4}Y_{0.4}Mn_{0.2}$ magnesium alloy sheet (1 mm in thickness) of Example 10 disclosed herein.

The $Mg_{95}Al_3Zn_1Ca_{0.4}Y_{0.4}Mn_{0.2}$ sheet has a yield strength of 205 MPa, a tensile strength of 280 MPa, an elongation to failure of 18 percent and an IE value of 4.5. The microstructure photograph of this sheet after rolling and annealing is shown in FIG. 10.

Example 11

$Mg_{95.2}Zn_3Al_1Ca_{0.3}Gd_{0.3}Mn_{0.2}$ magnesium alloy sheet (1 mm in thickness): weighting raw materials according to the mass percent of composition, wherein the raw materials were: magnesium ingot of 99.99 mass percent, aluminum ingot of 99.9 mass percent, zinc ingot of 99.99 mass percent, master alloy of magnesium and calcium of 30 mass percent, master alloy of magnesium and gadolinium of 30 mass percent, and master alloy of magnesium and manganese of 30 mass percent. The burdening was carried out, according to the nominal composition of the magnesium alloy, and also in consideration of the thermal loss of each of elements.

Melting and casting of $Mg_{95.2}Zn_3Al_1Ca_{0.3}Gd_{0.3}Mn_{0.2}$. The raw materials were charged into a crucible in a vacuum induction melting furnace and the melting furnace was vacuumed and heated under inert atmosphere. The temperature was increased to 750° C. and maintained for 15 minutes. After the raw materials were completely melted, the melts were electromagnetically stirred for about 10 minutes. Finally, the melts were poured into the graphite crucible and placed in the air to cool, giving an ingot.

Solid solution treatment of $Mg_{95.2}Zn_3Al_1Ca_{0.3}Gd_{0.3}Mn_{0.2}$. The magnesium alloy ingot was placed in a resistance furnace and kept at 300° C. for 20 hours, and then air-cooled to room temperature.

Hot rolling of $Mg_{95.2}Zn_3Al_1Ca_{0.3}Gd_{0.3}Mn_{0.2}$. The magnesium alloy ingot after the solid solution treatment was wire-cut into a slab having a thickness of 10 mm, and then the surface of the slab was polished for hot rolling. The specific hot rolling process was as follows: the slab was kept at 400° C. for about 30 minutes and then was hot rolled. The total thickness reduction by hot rolling was 90 percent, that is, the final thickness of sheet was 1 mm. The thickness reductions of the first two passes were 8 percent and 10 percent, respectively, and the thickness reductions of other passes were controlled within 10 to 30 percent, wherein the thickness reductions of the last two passes were 15 percent and 10 percent, respectively. Due to the fast heat dissipation of the magnesium alloy, in order to stabilize the temperature during the rolling, the sample was kept at 400° C. for 8 minutes in the resistance furnace after each rolling pass. After the hot rolling, the defects at head, tail and edges of the hot rolled sheet were cut to obtain a hot rolled magnesium alloy sheet with good shape.

Annealing of the hot rolled $Mg_{95.2}Zn_3Al_1Ca_{0.3}Gd_{0.3}Mn_{0.2}$ sheet. The finally rolled sheet was placed into a resistance furnace and kept at 350° C. for 60 minutes.

Figure 11:
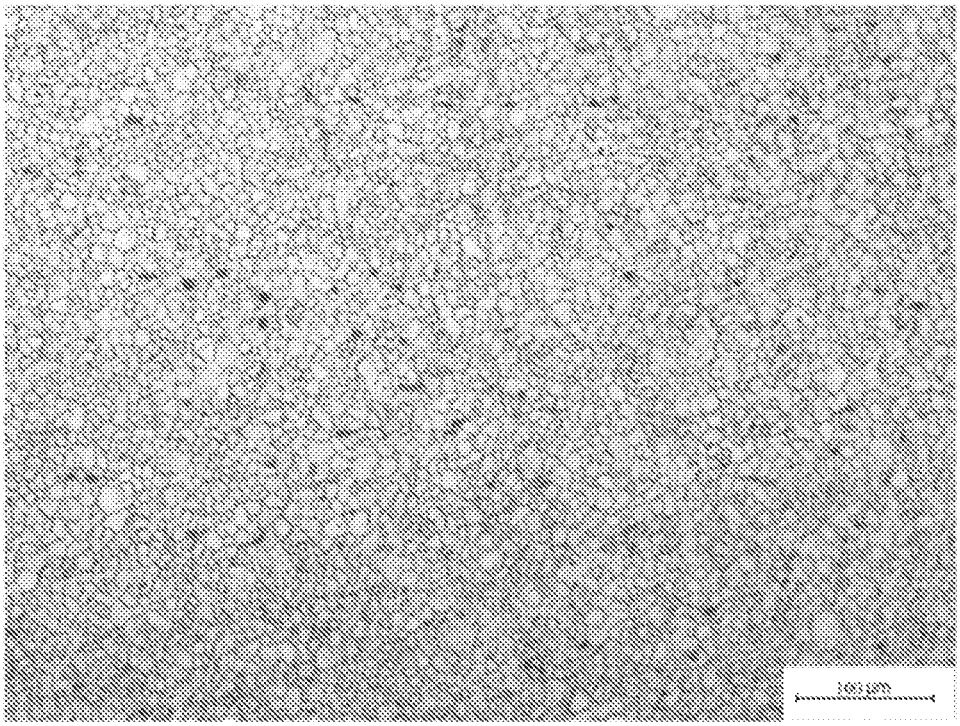
FIG. 11 is a microstructure photograph of the rolled and annealed $Mg_{95}Zn_3Al_1Ca_{0.3}Gd_{0.3}Mn_{0.2}$ magnesium alloy sheet (1 mm in thickness) of Example 11 disclosed herein.

The $Mg_{95.2}Zn_3Al_1Ca_{0.3}Gd_{0.3}Mn_{0.2}$ sheet has a yield strength of 210 MPa, a tensile strength of 275 MPa, an elongation to failure of 22 percent and an IE value of 5. The microstructure photograph of this sheet after rolling and annealing is shown in FIG. 11.

Compared with the prior art, the tensile strength, the ductility and IE value of the present invention are significantly improved. As shown in Table 3, the commonly rolled AZ31 (NR) only has an IE value of 3.45 (prior art 1), and even using differential speed rolling (DSR), its IE value is only increased to 3.73 (prior art 2). As disclosed herein, the chemical composition has been modified and adds 0.2 wt % Ca and 0.2 wt % Gd on the basis of AZ21, and the tensile strength thereof is increased to 260 MPa, the elongation to failure to 21 percent, and the IE value to 5.87 (Example 1). Further, the content of Al is reduced and the strengthening element Zn is added so as to obtain $Mg_{96.6}Zn_2Al_1Ca_{0.2}Gd_{0.2}$, the IE value of which is increased to 6.67 (Example 4). Further, on the basis of $Mg_{96.6}Zn_2Al_1Ca_{0.2}Gd_{0.2,\ 0.1}$ wt % Gd is reduced and 0.1 wt % Y is added, so as to obtain $Mg_{96.4}Zn_2Al_1Ca_{0.2}Gd_{0.1}Y_{0.1}Mn_{0.2}$, the tensile-strength of which is increased to 265.6 MPa. On the other hand, in order to further increase mechanical properties, more Al/Zn, Ca, Gd/Y and Mn elements were added based on $Mg_{96.6}Al_2Zn_1Ca_{0.2}Gd_{0.2}$ (Example 1) and $Mg_{96.6}Zn_2Al_1Ca_{0.2}Gd_{0.2}$ (Example 4) to obtain $Mg_{95}Al_3Zn_1Ca_{0.4}Gd_{0.4}Mn_{0.2}$ (Example 9), $Mg_{95}Al_3Zn_1Ca_{0.4}Y_{0.4}Mn_{0.2}$ (Example 10) and $Mg_{95.2}Zn_3Al_1Ca_{0.3}Gd_{0.3}Mn_{0.2}$ (Example 11). In addition, the disclosed magnesium alloys contain a lower content of rare earth elements, have a better processability, and have a higher yield during the whole preparation process including melting, extruding, rolling, etc. Therefore, the disclosed magnesium alloy not only has a high room temperature formability, better mechanical properties, and anti-flammability and corrosion-resistance performance, but also has a low cost in preparation, and may be an ideal material for forming non-structural parts in the aerospace field and the like.

TABLE 3

| Alloy | Yield strength/MPa | Tensile strength/MPa | Elongation to failure/% | IE value | Illustration |
|---|---|---|---|---|---|
| AZ31(NR) | — | — | — | 3.45 | Prior art 1 |
| AZ31 (DSR) | — | — | — | 3.73 | Prior art 2 |
| $Mg_{96.6}Al_2Zn_1Ca_{0.2}Gd_{0.2}$ | 231.0 | 260.0 | 21.0 | 5.87 | Example 1 |
| $Mg_{96.6}Al_2Zn_1Ca_{0.2}Gd_{0.2}$ | 167.0 | 245.0 | 19.0 | — | Example 2 |
| $Mg_{96.6}Al_2Zn_1Ca_{0.2}Gd_{0.2}$ | 231.0 | 249.0 | 23.0 | 5.51 | Example 3 |
| $Mg_{96.6}Zn_2Al_1Ca_{0.2}Gd_{0.2}$ | 145.0 | 245.0 | 26.0 | 6.67 | Example 4 |

TABLE 3-continued

| Alloy | Yield strength/MPa | Tensile strength/MPa | Elongation to failure/% | IE value | Illustration |
|---|---|---|---|---|---|
| $Mg_{96.6}Zn_2Al_1Ca_{0.2}Gd_{0.2}$ | 227.0 | 250.0 | 23.0 | — | Example 5 |
| $Mg_{96.6}Zn_2Al_1Ca_{0.2}Gd_{0.2}$ | 184.8 | 252.6 | 31.4 | 5.93 | Example 6 |
| $Mg_{96.6}Zn_2Al_1Ca_{0.2}Gd_{0.2}$ | 170.0 | 255.0 | 24.0 | 5.63 | Example 7 |
| $Mg_{96.4}Zn_2Al_1Ca_{0.2}Gd_{0.1}Y_{0.1}Mn_{0.2}$ | 202.8 | 265.6 | 26.6 | 5.10 | Example 8 |
| $Mg_{95}Al_3Zn_1Ca_{0.4}Gd_{0.4}Mn_{0.2}$ | 200.0 | 275.0 | 20.0 | 5.00 | Example 9 |
| $Mg_{95}Al_3Zn_1Ca_{0.4}Y_{0.4}Mn_{0.2}$ | 205.0 | 280.0 | 18.0 | 4.50 | Example 10 |
| $Mg_{95}Zn_3Al_1Ca_{0.3}Gd_{0.3}Mn_{0.2}$ | 210.0 | 275.0 | 22.0 | 5.00 | Example 11 |

Table 1 shows the mechanical properties and IE values for alloys AZ31 (NR) (prior art 1), AZ31 (DSR) (prior art 2), $Mg_{96.6}Al_2Zn_1Ca_{0.2}Gd_{0.2}$ (Examples 1-3), $Mg_{96.6}Zn_2Al_1Ca_{0.2}Gd_{0.2}$ (Examples 4-7), $Mg_{96.4}Zn_2Al_1Ca_{0.2}Gd_{0.1}Y_{0.1}Mn_{0.2}$ (Example 8), $Mg_{95}Al_3Zn_1Ca_{0.4}Y_{0.4}Mn_{0.2}$ (Example 9), $Mg_{95}Al_3Zn_1Ca_{0.4}Y_{0.4}Mn_{0.2}$ (Example 10) and $Mg_{95}Zn_3Al_1Ca_{0.3}Gd_{0.3}Mn_{0.2}$ (Example 11).

Although various embodiments of the disclosed calcium-bearing magnesium and rare earth element alloys and methods have been shown and described, modifications may occur to those skilled in the art upon reading the specification. The present application includes such modifications and is limited only by the scope of the claims.

What is claimed is:

1. A method for manufacturing a magnesium alloy sheet comprising:

weighting raw materials to obtain a desired composition;

charging said raw materials into a vacuum induction melting furnace to obtain a molten mass;

casting said molten mass to yield a magnesium alloy ingot consisting essentially of: about 1 to about 3 percent by weight zinc; about 1 to about 3 percent by weight aluminum; about 0.1 to about 0.4 percent by weight calcium; about 0.1 to about 0.4 percent by weight gadolinium; zero to about 0.4 percent by weight yttrium; zero to about 0.2 percent by weight manganese; and balance magnesium;

solid solution treating said magnesium alloy ingot to yield a treated magnesium alloy ingot;

hot rolling said treated magnesium alloy ingot to yield a rolled material;

cutting defects from said rolled material to obtain said magnesium alloy sheet; and annealing said magnesium alloy sheet, wherein the magnesium alloy sheet has a tensile strength of at least 245.0 MPa, an elongation to failure of at least 18.0%, and an IE value of at least 4.50.

2. The method of claim 1, wherein said raw materials comprise:

a magnesium ingot of no less than 99.99 mass percent purity;

an aluminum ingot of no less than 99.9 mass percent purity;

a zinc ingot of no less than 99.99 mass percent purity;

a master alloy of magnesium and calcium;

a master alloy of magnesium and gadolinium;

optionally, a master alloy of magnesium and yttrium; and optionally, a master alloy of magnesium and manganese.

3. The method of claim 1, wherein said charging comprises heating said raw materials to at least 750° C. for about 10 to about 15 minutes.

4. The method of claim 1, further comprising, prior to said casting, stirring said molten mass for about 5 to about 10 minutes, wherein said stirring comprises at least one of electromagnetic stirring, mechanical stirring and gas stirring.

5. The method of claim 1, wherein said solid solution treating comprises maintaining said magnesium alloy ingot at a temperature of about 300 to about 450° C. for about 12 to about 24 hours, and then air-cooling to room temperature.

6. The method of claim 1, wherein said hot rolling is performed at a temperature of about 400 to about 450° C. in multiple passes, wherein said hot rolling achieves a total reduction in thickness of about 90 percent, wherein thickness reductions within about 15 percent are achieved during first two passes of said multiple passes, wherein thickness reductions within about 8 to about 18 percent are achieved during last two passes of said multiple passes, and wherein thickness reductions within about 10 to about 30 percent are achieved during other passes of said multiple passes.

7. The method of claim 1, further comprising extruding said treated magnesium alloy ingot prior to said hot rolling.

8. The method of claim 7, wherein said extruding comprises extruding said treated magnesium alloy ingot at about 250 to about 350° C. into one of a plate having a thickness of about 5 to about 20 mm and a rod having a diameter of about 20 to about 25 mm, wherein the extrusion ratio is about 16 to about 23 to 1, and the extrusion rate is about 0.5 to about 3 mm/s.

9. The method of claim 8, wherein said hot rolling is performed at a temperature of about 400 to about 450° C. in multiple passes, wherein said hot rolling achieves a sheet having a thickness of about 1 mm, wherein thickness reductions within about 20 percent are achieved during first two passes of said multiple passes, wherein thickness reductions within about 10 to about 25 percent are achieved during last two passes of said multiple passes, and wherein thickness reductions within about 15 to about 35 percent are achieved during other passes of said multiple passes.

10. The method of claim 1, further comprising isothermal forging said treated magnesium alloy ingot prior to said hot rolling.

11. The method of claim 10, wherein said isothermal forging is performed at a temperature of about 300 to about 350° C. and a forging rate of about 1 to about 3 mm/s to yield a thin round billet and a total reduction in thickness of about 75 to about 85 percent.

12. The method of claim 11, wherein said hot rolling is performed at a temperature of about 400 to about 450° C. in multiple passes, wherein said hot rolling achieves a thin plate having a thickness of about 1 mm, wherein thickness reductions within about 20 percent are achieved during first two passes of said multiple passes, wherein thickness reductions within about 10 to about 25 percent are achieved during last two passes of said multiple passes, and wherein thickness reductions within about 15 to about 35 percent are achieved during other passes of said multiple passes.

13. The method of claim 1, wherein said annealing comprising maintaining said alloy sheet at a temperature of about 350° C. for about 30 to about 60 minutes.

14. The method of claim 1, wherein said yttrium is present at a non-zero quantity.

15. The method of claim 1, wherein said manganese is present at a non-zero quantity.

16. The method of claim 1, wherein:

said zinc is present at about 1 to about 2 percent by weight;

said aluminum is present at about 1 to about 2 percent by weight;

said calcium is present at about 0.1 to about 0.2 percent by weight;

said gadolinium is present at about 0.1 to about 0.2 percent by weight;

said yttrium is present at about 0 to about 0.2 percent by weight; and said manganese is present at about 0 to about 0.2 percent by weight.

17. The method of claim 1, further comprising forming the magnesium alloy sheet at room temperature.

18. A method for manufacturing a magnesium alloy sheet comprising:

forming the magnesium alloy sheet at room temperature, the magnesium alloy sheet consisting essentially of: about 1 to about 3 percent by weight zinc; about 1 to about 3 percent by weight aluminum; about 0.1 to about 0.4 percent by weight calcium; about 0.1 to about 0.4 percent by weight gadolinium; zero to about 0.4 percent by weight yttrium; zero to about 0.2 percent by weight manganese; and balance magnesium, wherein the magnesium alloy sheet has a tensile strength of at least 245.0 MPa, an elongation to failure of at least 18.0%, and an IE value of at least 4.50.

19. The method of claim 18, wherein:

said zinc is present at about 1 to about 2 percent by weight;

said aluminum is present at about 1 to about 2 percent by weight;

said calcium is present at about 0.1 to about 0.2 percent by weight;

said gadolinium is present at about 0.1 to about 0.2 percent by weight;

said yttrium is present at about 0 to about 0.2 percent by weight; and said manganese is present at about 0 to about 0.2 percent by weight.

20. The method of claim 18, wherein the magnesium alloy sheet has an elongation to failure of at least 24.0%.

* * * * *